US007737358B2

(12) United States Patent
Hopkinson et al.

(10) Patent No.: US 7,737,358 B2
(45) Date of Patent: Jun. 15, 2010

(54) DATA TRANSMISSION CABLE PAIRS AND CABLES AND METHODS FOR FORMING THE SAME

(75) Inventors: Wayne Charles Hopkinson, Hickory, NC (US); Trent Mitchel Hayes, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/062,700

(22) Filed: Apr. 4, 2008

(65) Prior Publication Data

US 2008/0251277 A1 Oct. 16, 2008

Related U.S. Application Data

(60) Provisional application No. 60/911,384, filed on Apr. 12, 2007.

(51) Int. Cl.
*H01B 7/00* (2006.01)

(52) U.S. Cl. ..... 174/27; 174/113 R; 174/117 FF; 174/129 R

(58) Field of Classification Search ..... 174/117 FF, 174/113 R, 27, 129 R
See application file for complete search history.

(56) References Cited

U.S. PATENT DOCUMENTS

| | | | | |
|---|---|---|---|---|
| 1,853,677 | A | 4/1932 | Fischer | |
| 6,225,563 | B1 | 5/2001 | Poulsen | |
| 6,422,893 | B1 | 7/2002 | Caldwell | |
| 6,465,094 | B1 * | 10/2002 | Dugan | 428/370 |
| 6,800,811 | B1 | 10/2004 | Boucino | |
| 6,989,486 | B2 * | 1/2006 | Lovoi et al. | 174/28 |
| 7,188,653 | B2 * | 3/2007 | Doujak | 152/451 |
| 7,449,639 | B2 * | 11/2008 | Nair | 174/113 R |
| 2007/0119609 | A1 | 5/2007 | Somers | |

OTHER PUBLICATIONS

International Search Report and Written Opinion (12 pages) corresponding to PCT/US2008/004500, Mailing Date Aug. 29, 2008.

* cited by examiner

*Primary Examiner*—Chau N Nguyen
(74) *Attorney, Agent, or Firm*—Myers Bigel Sibley & Sajovec

(57) ABSTRACT

A data transmission pair includes first and second longitudinally extending electrical conductors each having a longitudinally extending, substantially flat side surface. The first and second conductors are paired such that their respective flat side surfaces face one another. The pair further includes an insulation cover having a separator portion and surrounding the first and second conductors. The separator portion is interposed between and separates the respective flat side surfaces of the first and second conductors.

15 Claims, 8 Drawing Sheets

DATA TRANSMISSION CABLE PAIRS AND CABLES AND METHODS FOR FORMING THE SAME

RELATED APPLICATION(S)

The present application claims the benefit of U.S. Provisional Patent Application Ser. No. 60/911,384, filed Apr. 12, 2007, the disclosure of which is hereby incorporated herein by reference in its entirety.

FIELD OF THE INVENTION

The present invention relates to cables and, more particularly, data transmission cables and methods for forming the same.

BACKGROUND

Data transmission cables, such as LAN cables, may include one or more untwisted or twisted pairs of conductors. Such cables may suffer from crosstalk between twisted conductor pairs of the same or other cables (e.g., NEXT, FEXT, ELFEXT, ANEXT, and/or AELFEXT).

SUMMARY OF THE INVENTION

According to embodiments of the present invention, a data transmission pair includes first and second longitudinally extending electrical conductors each having a longitudinally extending, substantially flat side surface. The first and second conductors are paired such that their respective flat side surfaces face one another. The pair further includes an insulation cover having a separator portion and surrounding the first and second conductors. The separator portion is interposed between and separates the respective flat side surfaces of the first and second conductors.

In some embodiments, the opposed flat side surfaces of the first and second conductors are oriented substantially parallel to one another.

According to some embodiments, each of the first and second conductors has a cross-sectional shape that is asymmetric. The first and second conductors may each be substantially D-shaped in cross-section.

According to some embodiments, the first and second conductors are helically twisted about one another. In some embodiments, the first and second conductors are helically twisted about one another such that the flat side surfaces take the form of helically wound flat surfaces that are substantially parallel to one another along the length of the pair and the separator portion of the insulation cover forms a helically wound ribbon interposed between the flat side surfaces of the first and second conductors.

In some embodiments, each of the flat side surfaces does not deviate from fully flat by more than 10 mils.

According to some embodiments, a maximum separation distance between the flat side surfaces of the first and second conductors is not more than 15% greater than a minimum separation distance between the flat side surfaces of the first and second conductors.

The insulation cover may include the separator portion and an outer insulation portion at least partly surrounding the first and second conductors, and the separator portion is separately formed from and bonded to the outer insulation portion.

In some embodiments, the insulation cover includes first and second outer insulation portions at least partly surrounding the first and second conductors, respectively, and the first and second outer insulation portions are separately formed from and bonded to one another.

According to some embodiments, the insulation cover includes pockets defined in the separator portion between the flat side surfaces of the first and second conductors, and the pockets contain gas.

According to some embodiments, a data transmission pair includes a pair and an outer cable jacket. The pair includes first and second longitudinally extending electrical conductors each having a longitudinally extending, substantially flat side surface. The first and second conductors are paired such that their respective flat side surfaces face one another. The pair further includes an insulation cover having a separator portion and surrounding the first and second conductors. The separator portion is interposed between and separates the respective flat side surfaces of the first and second conductors. The outer cable jacket surrounds the pair.

According to some embodiments, the cable further includes a second pair. The second pair includes: third and fourth longitudinally extending electrical conductors each having a longitudinally extending, substantially flat side surface, wherein the third and fourth conductors are paired such that their respective flat side surfaces face one another; and a second insulation cover having a second separator portion and surrounding the third and fourth conductors, the second separator portion being interposed between and separating the respective flat side surfaces of the third and fourth conductors. The outer jacket surrounds the first and second pairs.

According to some embodiments, the cable further includes third and fourth pairs. The third pair includes: fifth and sixth longitudinally extending electrical conductors each having a longitudinally extending, substantially flat side surface, wherein the fifth and sixth conductors are paired such that their respective flat side surfaces face one another; and a third insulation cover having a third separator portion and surrounding the fifth and sixth conductors, the third separator portion being interposed between and separating the respective flat side surfaces of the fifth and sixth conductors. The fourth pair includes: seventh and eighth longitudinally extending electrical conductors each having a longitudinally extending, substantially flat side surface, wherein the seventh and eighth conductors are paired such that their respective flat side surfaces face one another; and a fourth insulation cover having a fourth separator portion and surrounding the seventh and eighth conductors, the fourth separator portion being interposed between and separating the respective flat side surfaces of the seventh and eighth conductors. The outer jacket surrounds the first, second, third and fourth pairs.

According to embodiments of the present invention, a data transmission pair includes first and second longitudinally extending electrical conductors paired together and each having a cross-sectional shape that is asymmetric. The pair further includes an insulation cover having a separator portion and surrounding the first and second conductors. The separator portion is interposed between and separates the first and second conductors.

In some embodiments, the first and second conductors are helically twisted about one another and the separator portion of the insulation cover forms a helically wound ribbon interposed between the first and second conductors.

The first and second conductors may be rotationally asymmetric in cross-section.

According to some embodiments, a data transmission pair includes a pair and an outer cable jacket. The pair includes first and second longitudinally extending electrical conductors paired together and each having a cross-sectional shape that is asymmetric. The pair further includes an insulation cover having a separator portion and surrounding the first and second conductors. The separator portion is interposed between and separates the first and second conductors. The outer cable jacket surrounds the pair.

According to embodiments of the present invention, a data transmission pair includes first and second longitudinally extending electrical conductors each having a longitudinally and widthwise extending side surface, wherein the first and second conductors are paired such that their respective side surfaces face one another. The pair further includes an insulation cover having a separator portion and surrounding the first and second conductors. The separator portion is interposed between and separates the respective side surfaces of the first and second conductors. The respective shapes of the side surfaces of the first and second conductors are dissimilar. The respective shapes of the side surfaces of the first and second conductors are complementary to one another. The side surfaces of the first and second conductors are spaced apart from one another a substantially uniform spacing distance along their widths.

According to some embodiments, a maximum separation distance between the side surfaces of the first and second conductors is not more than 15% greater than a minimum separation distance between the side surfaces of the first and second conductors.

In some embodiments, the shape of the side surface of the first conductor is generally concave and the shape of the side the surface of the second conductor is generally convex.

According to some embodiments, the first conductor includes first and second conductor walls, and the second conductor includes a conductor wall interposed between the first and second conductor walls of the first conductor.

In some embodiments, the first and second conductors are helically twisted about one another and the separator portion of the insulation cover forms a helically wound ribbon interposed between the first and second conductors.

The first and second conductors may be rotationally asymmetric in cross-section.

According to some embodiments, a data transmission pair includes a pair and an outer cable jacket. The pair includes first and second longitudinally extending electrical conductors each having a longitudinally and widthwise extending side surface, wherein the first and second conductors are paired such that their respective side surfaces face one another. The pair further includes an insulation cover having a separator portion and surrounding the first and second conductors. The separator portion is interposed between and separates the respective side surfaces of the first and second conductors. The respective shapes of the side surfaces of the first and second conductors are dissimilar. The respective shapes of the side surfaces of the first and second conductors are complementary to one another. The side surfaces of the first and second conductors are spaced apart from one another a substantially uniform spacing distance along their widths. The outer cable jacket surrounds the pair.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
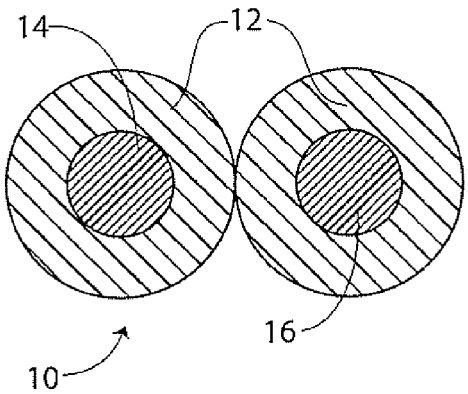
Fig. 1 (Prior Art)
FIG. 1 is a cross-sectional view of a prior art cable pair.

The present invention now will be described hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
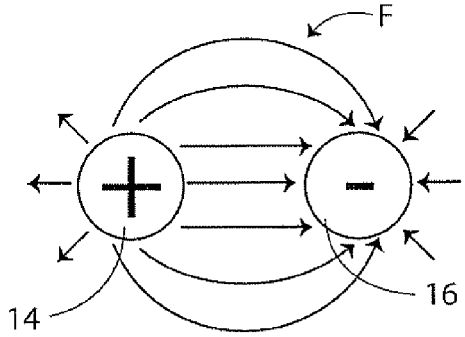
Fig. 2 (Prior Art)
FIG. 2 is a schematic view of conductors and electric field lines of the prior art pair of FIG. 1.

FIG. 1 illustrates (in cross-section) an exemplary and typical cable pair 10 of the prior art having first and second conductors 14, 16 surrounded by insulation covers 12. The conductors 14, 16 are each fully round in cross-section and may be helically twisted about one another. As schematically illustrated in FIG. 2, in use electric field lines F generated by and between the conductors 14, 16 may fringe widely. Such fringing may present a relatively strong electromagnetic field (EMF) structure surrounding the conductor pair 14, 16. This EMF may have sufficient energy to couple with a neighboring conductor pair in the form of near-end crosstalk (NEXT) or far-end crosstalk (FEXT).

The inventors have recognized that electric field lines terminate perpendicularly on perfect conductors in a data transmission line or cable. The inventors have further recognized that the extent to which the fields between conductors fringe is influenced by the shape of the conductors forming the pair and will have an impact on the crosstalk between pairs. In accordance with embodiments of the present invention, the foregoing problems of cables having conductors that are circular in cross-section can be prevented or reduced.

In some embodiments, the foregoing problems of known cables are prevented or reduced by providing a cable including paired first and second electrical conductors each having an opposing side surface facing the other and relatively arranged and shaped to provide a substantially uniform spacing between the opposed side surfaces throughout their widths, with a section of electrical insulation interposed between the side surfaces. In some embodiments, the foregoing problems of known cables are prevented or reduced by providing a cable including paired first and second electrical conductors each having a flat side surface facing the other with a section of electrical insulation interposed between the flat side surfaces. According to some embodiments, the conductors are asymmetrically shaped in cross-section. According to some embodiments, the conductors are rotationally asymmetric in cross-section.

Figure 3:
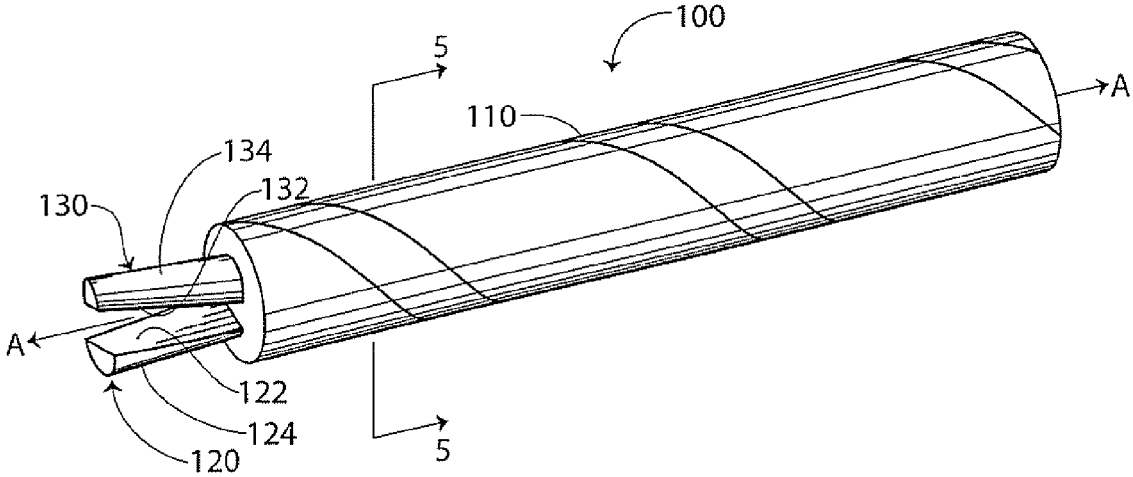
FIG. 3 is a perspective view of a pair according to embodiments of the present invention.

With reference to FIGS. 3-6, a cable pair 100 according to embodiments of the present invention is shown therein. The pair 100 extends generally longitudinally along a cable lengthwise axis A-A (FIG. 3). The pair 100 includes a first longitudinally extending conductor 120, a second longitudinally extending conductor 130, and a longitudinally extending insulation cover 110. The insulation cover 110 includes an outer portion 112 that surrounds the conductors 120, 130, and a separator portion 114 that is interposed between the conductors 120, 130. According to some embodiments, the insulation cover 110 fully conforms to the conductors 120, 130.

The conductors 120, 130 may be formed of any suitable electrically conductive material. According to some embodiments, the conductors 120, 130 are formed of copper.

The insulation cover 110 may be formed of any suitable electrically insulating or dielectric material. According to some embodiments, the insulation cover 110 is formed of high density polyethylene (HDPE). According to some embodiments, the cover 110 is integral and unitary and, according to some embodiments, integrally and unitarily formed such as by extrusion.

Figure 5:
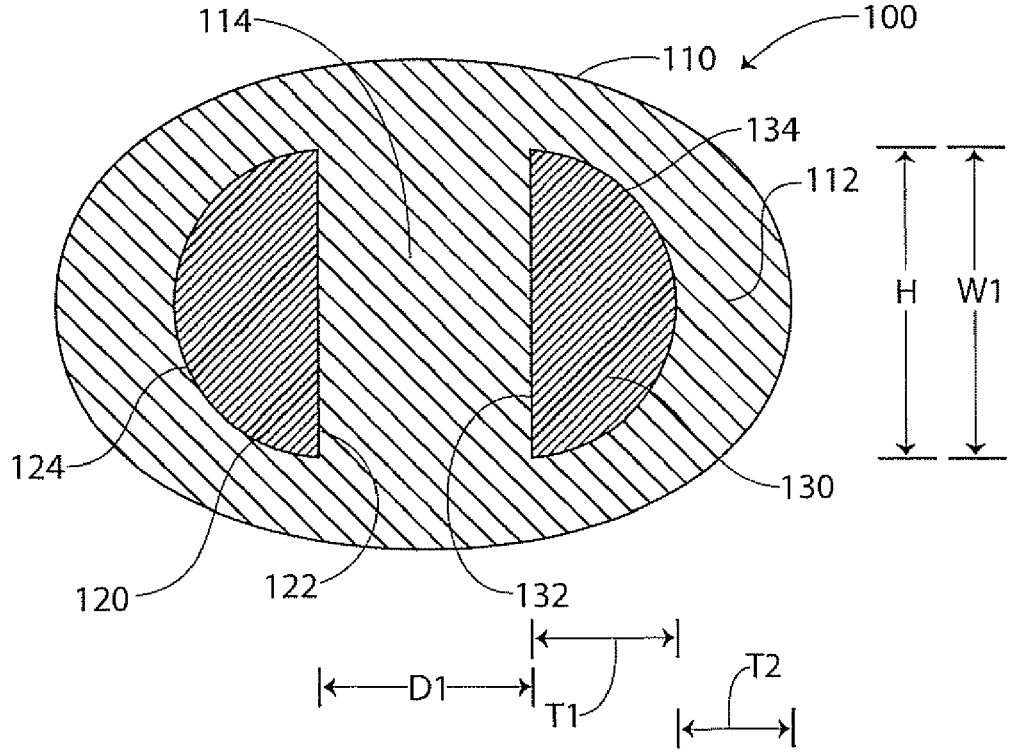
FIG. 5 is a cross-sectional view of the cable of FIG. 3 taken along the line 5-5 of FIG. 3.

With reference to FIG. 5, it will be seen that each conductor 120, 130 has a semi-circular shape or D-shape in cross-section. More particularly, an inner surface 122, 132 of each conductor 120, 130 is flat or planar while an outer surface 124, 134 of each conductor 120, 130 is rounded. The conductors 120, 130 are relatively oriented such that the flat surfaces 122, 132 of the conductors 120, 130 face and are parallel with one another. According to some embodiments, the flat surfaces 122, 132 extend across the maximum width H or diameter of each conductor 120, 130.

Figure 4:
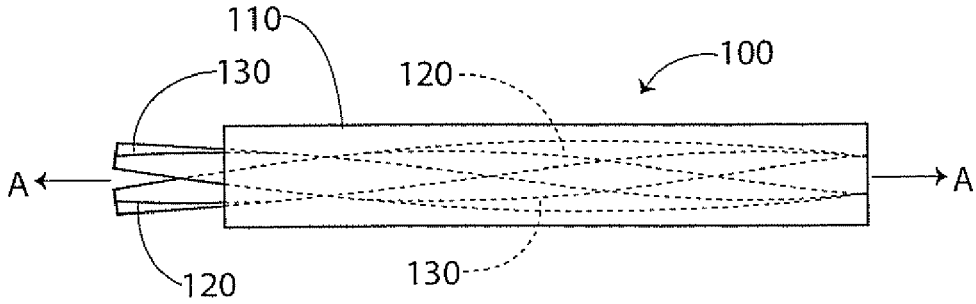
FIG. 4 is a side elevational view of the cable of FIG. 3.
Figure 6:
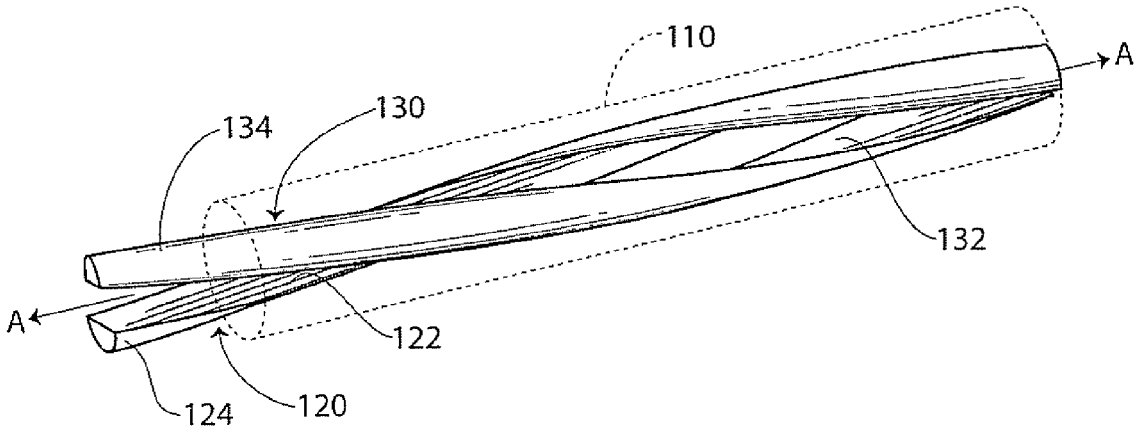
FIG. 6 is a perspective view of a twisted conductor pair of the cable of FIG. 3.

According to some embodiments, the pair 100 is twisted such that the conductors 120, 130 (encased in the insulation cover) are helically twisted about each other about a central twist axis (e.g., the central pair axis A-A). The respective flat surfaces 122, 132 are thereby twisted into the form of helically wound ribbons as best seen in FIGS. 3, 4 and 6 (FIG. 6 shows only the conductors 120, 130). At each point along the pair length the adjacent portions of the facing surfaces 122, 132 are substantially parallel to one another. These surfaces 122, 132 may be characterized or referred to as parallel helical surfaces. According to some embodiments, the conductors 120, 130 are twisted at a rate of between about 1 and 5 turns per inch.

According to other embodiments, the conductors 120, 130 are not helically twisted about one another.

The dimensions of the conductors 120, 130 and the insulation separator portion 114 may be chosen to ensure that the pair 100 provides sufficient impedance between the conductors 120, 130 and meets DC resistance requirements for the intended application. According to some embodiments, the impedance between the conductors 120, 130 is in the range of from about 95 to 105 Ohms. According to some embodiments, the DC resistance of the pair 100 is in the range of from about 5 to 10 Ohms.

With reference to FIG. 5, according to some embodiments, each flat surface 122, 132 has a width W1 of at least about 0.02 inches and, according to some embodiments, between about 0.01 and 0.03 inches.

According to some embodiments, each conductor 120, 130 has a height H (FIG. 5) of between about 0.01 and 0.03 inches. According to some embodiments, each conductor 120, 130 has a thickness T1 of between about 0.005 and 0.015 inches. According to some embodiments, each conductor 120, 130 has a height H to thickness T1 ratio of between about 1 and 3. According to some embodiments, each conductor 120, 130 has a cross-sectional area of between about $4\times10^{-5}$ and $3.5\times10^{-4}$ inches squared.

According to some embodiments, the nominal spacing or separation distance D1 (FIG. 5) between the conductors 120, 130 (i.e., the thickness of the separator portion 114) is in the range of from about 0.01 to 0.03 inches. According to some embodiments, the separation distance D1 is substantially uniform along the full width W1 of each conductor 120, 130. According to some embodiments, the separation distance D1 is substantially uniform along the length of the cable 100.

According, to some embodiments, the nominal thickness T2 (FIG. 5) of the skin or outer portion 112 of the insulation cover 110 is in the range of from about 0.001 to 0.02 inches. According to some embodiments, the thickness T2 is substantially uniform along the length of the pair 110.

Figure 8:
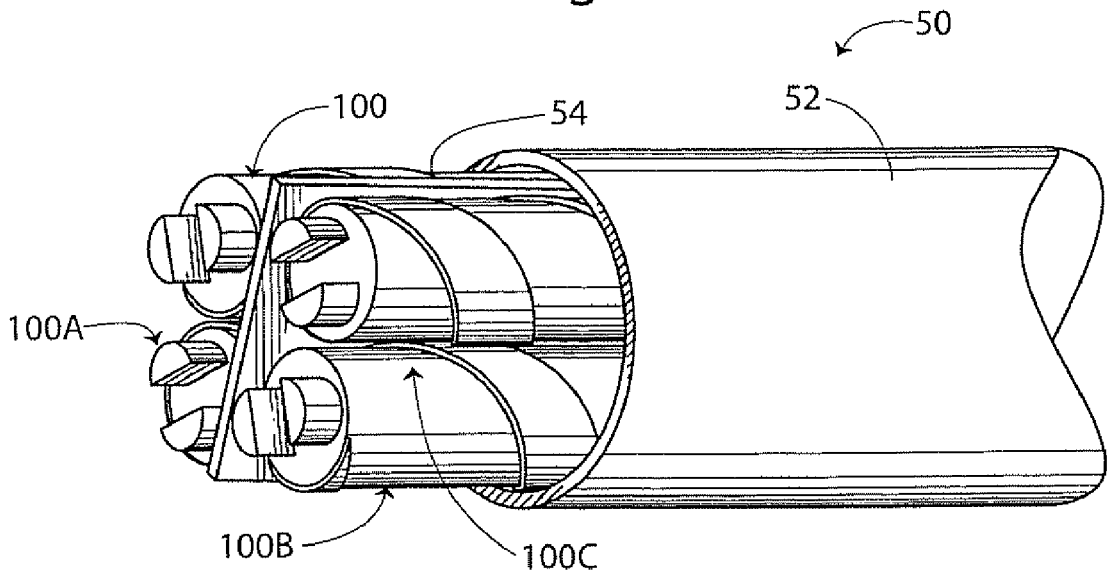
FIG. 8 is a perspective view of a cable assembly including four of the pairs of FIG. 3.
Figure 9:
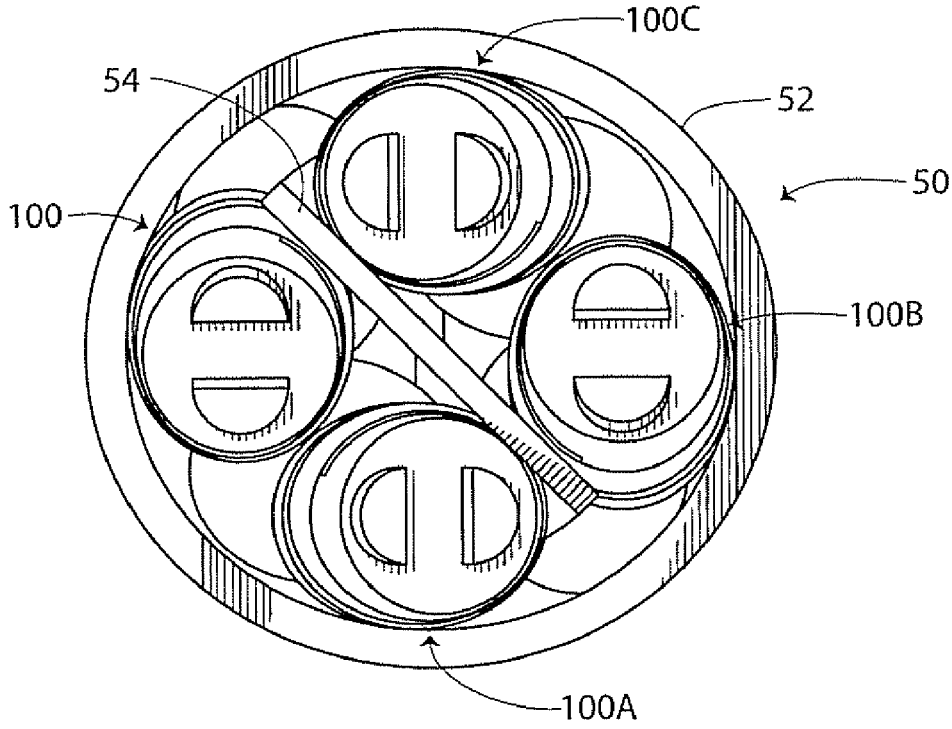
FIG. 9 is an end view of the cable assembly of FIG. 8.

The twisted pair 100 may be stranded together with additional pairs (e.g., pairs constructed in the same manner) and jacketed. For example, referring to FIGS. 8 and 9 (FIG. 9 is an end view), the pair 100 can be stranded with three other pairs 100A, 100B, 100C formed in accordance with the present invention. The pairs 100, 100A, 100B 100C can be covered by a jacket 52 to form a four conductor pair cable assembly 50. A divider strip 54 can be inserted between pairs 100, 100A, 100B, 100C. According to some embodiments, the cables 100-100C (and the strip 54, if present) are helically twisted about one another within the jacket 52. According to other embodiments, the pairs 100-100C are not twisted about one another. According to some embodiments, the conductors 120, 130 of each pair 100-100C are not twisted about one another.

Figure 7:
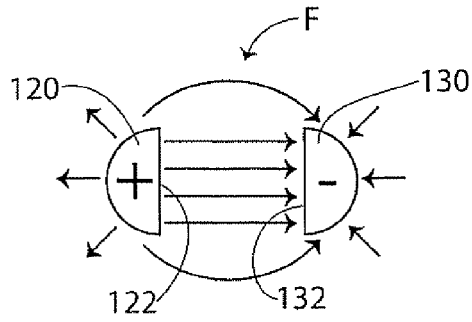
FIG. 7 is a schematic view of the conductors and electric field lines of the pair of FIG. 3.

In use, it is expected that the semi-circular or D-shaped conductors 120, 130 oriented in the manner depicted in FIGS. 3-7 will cause the electromagnetic field pattern to be more tightly bound to (i.e., concentrated in) the region between the conductors 120, 130, thereby reducing electrical field fringing. This field fringing reduction may be accomplished while maintaining the cross-sectional area of the conductors needed to satisfy the DC requirements of the cable application (according to some embodiments, unshielded twisted pair (UTP) category cabling). The field and effect are depicted in FIG. 7, wherein the field lines F are schematically illustrated. As illustrated, the electric field is tightly confined between the conductors by maintaining the substantially uniform distance between the adjacent opposing conductor surfaces 122, 132. As a result, it is expected that the field strength and thus the strength of signals coupled to neighboring pairs within a cable and between pairs in neighboring cables (i.e., crosstalk) will be reduced. It is desirable that crosstalk (a transmission impairment) be reduced as much as possible to aid in the distortionless transmission of electrical signals from one end of a multi-pair cable to another.

According to some embodiments, cable according to the present invention (e.g., the pair 100) may be formed in the following manner. The conductors 120, 130 are formed in the desired cross-sectional shape (e.g., D-shaped). The conductors 120, 130 are then paired together in an insulating operation. The conductors 120, 130 are then co-extruded such that the molten insulation cover material is applied (e.g., through an orifice) over both of the conductors 120, 130 and cooled to form a unitarily formed insulation cover 110. According to some embodiments, the conductors 120, 130 are routed through an extrusion tip and die as the insulation extrudate is applied to ensure proper positioning of the conductors 120, 130, including the proper relative spacing and orientations between the conductors 120, 130. The conductor and insulation assembly is then (following cooling) twisted (e.g., using a standard cable or wire pair twister) to form the twisted cable 100. The pair 100 may thereafter be stranded together with other pairs (if desired) and jacketed to form the cable assembly 50 as discussed above.

Figure 10:
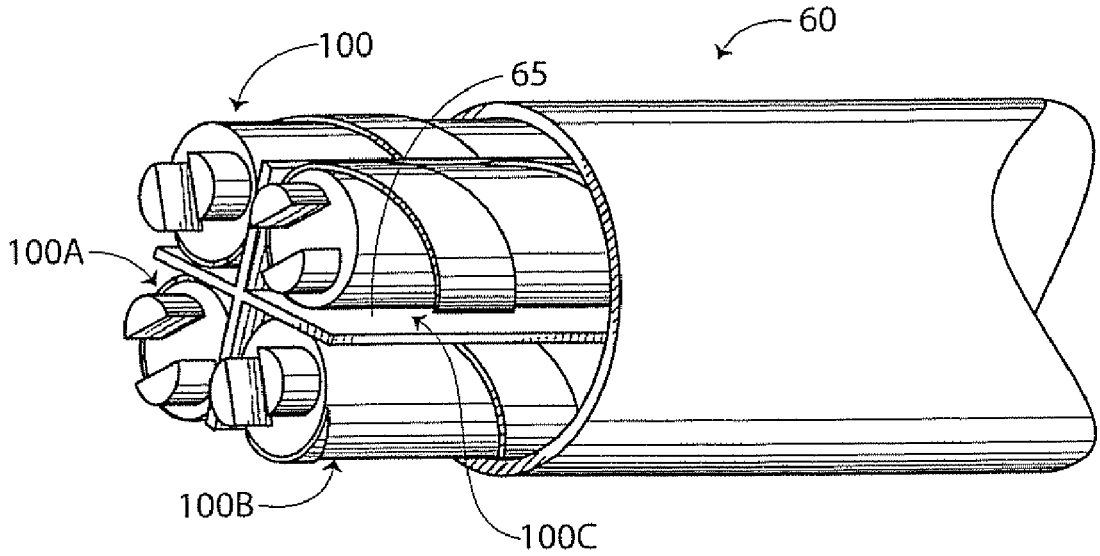
FIG. 10 is a perspective view of a cable assembly according to further embodiments of the present invention and including four of the pairs of FIG. 3.
Figure 11:
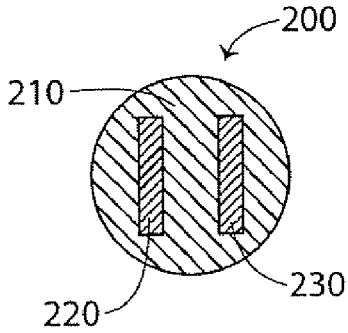
FIG. 11 is a cross-sectional view of a pair according to further embodiments of the present invention.
Figure 12:
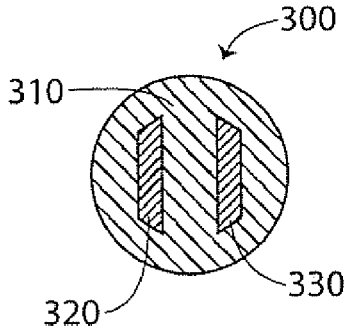
FIG. 12 is a cross-sectional view of a pair according to further embodiments of the present invention.
Figure 13:
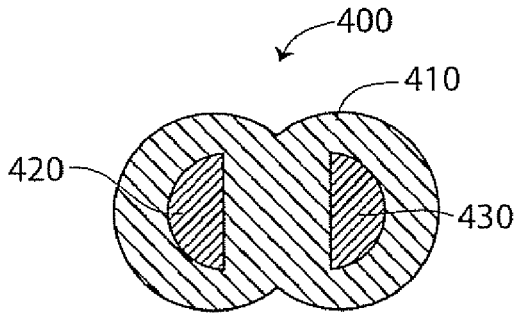
FIG. 13 is a cross-sectional view of a pair according to further embodiments of the present invention.
Figure 14:
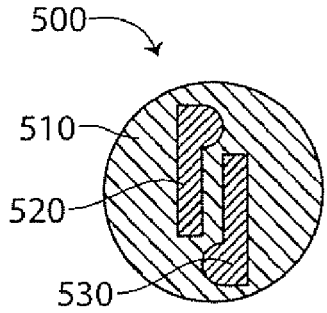
FIG. 14 is a cross-sectional view of a pair according to further embodiments of the present invention.

With reference to FIG. 10, a cable assembly 60 according to further embodiments of the present invention is shown therein. The cable assembly 60 corresponds to the cable assembly 50, except that the divider strip 54 is replaced with a cross-shaped or T-shaped divider strip 65 that separates each pair 100, 100A, 100B, 100C from the other. According to still further embodiments, the divider strip 54 or 65 can be omitted. Further examples of separator or divider strips that may be used in place of the divider strip 54 are disclosed in U.S. Pat. No. 6,800,811 to Boucino, which is incorporated herein by reference.

Cables according to the present invention may include conductors having different configurations than the pair 100. With reference to FIGS. 11-21, pairs 200, 300, 400, 500, 600, 700, 800, 900, 1000, 1100, 1200 according to further embodiments of the present invention are shown therein. The pairs 200, 300, 400, 500, 600, 700, 800, 900, 1000, 1100, 1200 may be formed in the same manner as the pair 100 except that the cross-sectional shapes of the conductors 220, 230, 320, 330, 420, 430, 520, 530, 620, 630, 720, 730, 820, 830, 920, 930, 1020, 1030, 1120, 1130, 1220, 1230 and/or the insulation covers 210, 310, 410, 510, 610, 710, 810, 910, 1010, 1110, 1210 are differently configured.

Figure 15:
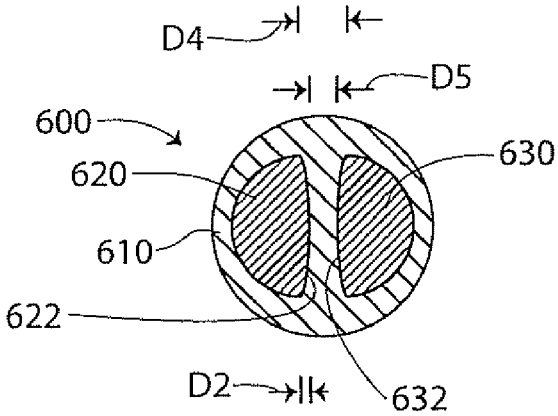
FIG. 15 is a cross-sectional view of a pair according to further embodiments of the present invention.

With reference to FIG. 15, the pair 600 is constructed in the same manner as the pair 100 except that the inner, opposed surfaces 622, 632 of the conductors 620, 630 are not completely flat across their width. According to some embodiments, the maximum deviation D2 from fully flat is no more than 10 mils.

Figure 16:
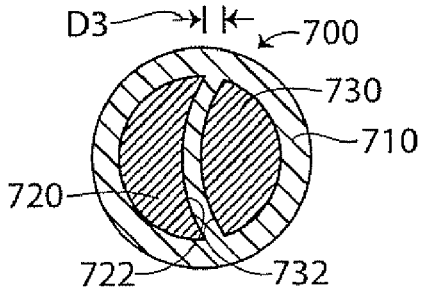
FIG. 16 is a cross-sectional view of a pair according to further embodiments of the present invention.

According to some embodiments, the opposing surfaces of the paired conductors have shapes that are dissimilar from, but complementary to, one another. With reference to FIG. 16, the pair 700 as shown therein includes an insulation cover 710, a first conductor 720 having a concave surface 722, and a second conductor 730 having a convex surface 732 facing the concave surface 722. The surfaces 722, 732 are complementary to one another along their respective widths to provide a substantial uniform spacing between the surfaces 722, 732 across the full widths of the conductors 720, 730.

Figure 17:
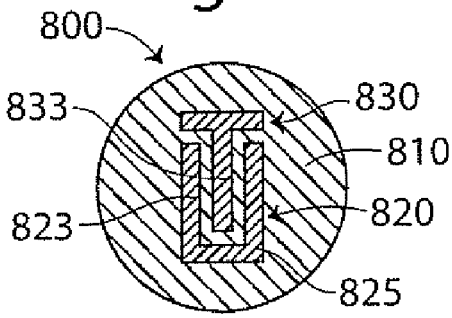
FIG. 17 is a cross-sectional view of a pair according to further embodiments of the present invention.

With reference to FIG. 17, the pair 800 includes an insulation cover 810, a first conductor 820 that is substantially U-shaped in cross-section, and a second conductor 830 that is substantially T-shaped in cross-section. The first conductor 820 has first and second conductor walls 823, 825 that are spaced apart. The second conductor 830 has a conductor wall 833 that is interposed between the conductor walls 823, 825.

Figure 18:
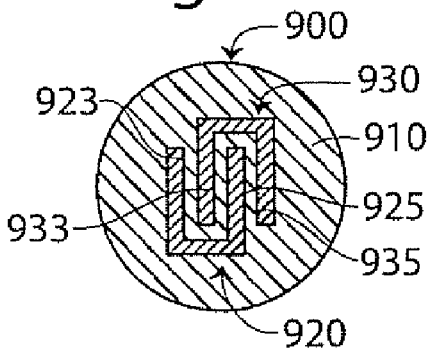
FIG. 18 is a cross-sectional view of a pair according to further embodiments of the present invention.

With reference to FIG. 18, the pair 900 corresponds to the pair 800 except that the second conductor 930 is also substantially U-shaped (but inverted). The conductor walls 923, 925, 933, 935 of the conductors 920, 930 are interleaved as shown to provide multiple adjacent to opposed surfaces.

Figure 19:
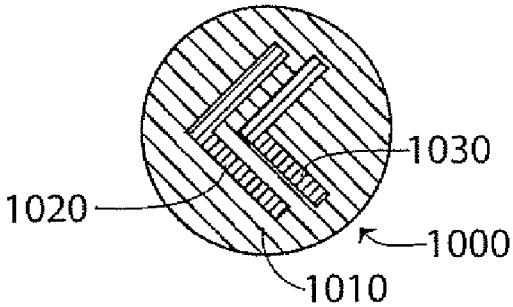
FIG. 19 is a cross-sectional view of a pair according to further embodiments of the present invention.

With reference to FIG. 19, the pair 1000 corresponds to the pair 900 except that the first and second conductors 1020, 1030 are both substantially V-shaped and the second conductor 1030 is inserted within the first conductor 1020 in complementary fashion.

Figure 20:
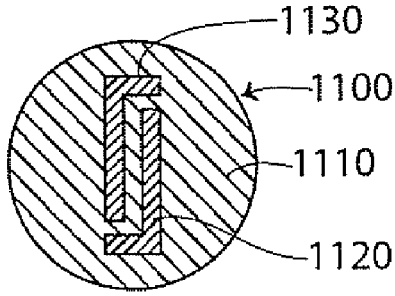
FIG. 20 is a cross-sectional view of a pair according to further embodiments of the present invention.

With reference to FIG. 20, the pair 1100 is constructed in the same manner as the pair 1000 except that the conductors 1120, 1130 are each L-shaped and configured and nested in relatively inverted and complementary arrangement.

Figure 21:
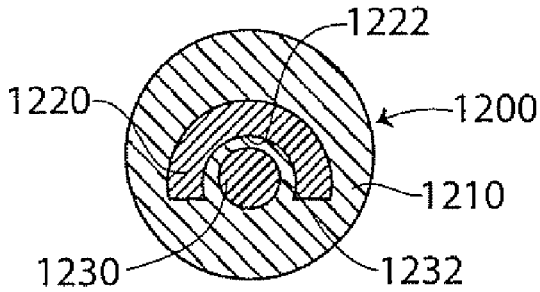
FIG. 21 is a cross-sectional view of a pair according to further embodiments of the present invention.

With reference to FIG. 21, the pair 1200 corresponds to the pair 700 except that the first conductor 1220 is substantially inverted U-shaped in cross-section and the second conductor 1230 is substantially circular in cross-section. The second conductor 1230 is received within the first conductor 1220 in complementary fashion to provide a substantial uniform spacing distance between a concave surface 1222 of the first conductor 1220 and an opposing convex surface 1232 of the second conductor 1230.

Figure 22:
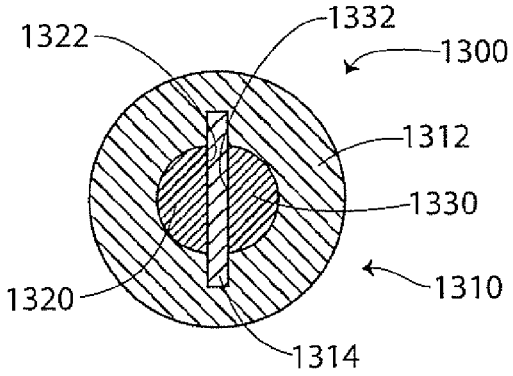
FIG. 22 is a cross-sectional view of a pair according to further embodiments of the present invention.

With reference to FIG. 22, a pair 1300 according to further embodiments of the present invention is shown therein. The pair 1300 is constructed in the same manner as the pair 100 except that the insulation cover 1310 includes two discrete parts 1312, 1314 that are bonded to one another to form the unitary insulation cover 1310. More particularly, the insulation cover 1310 includes an outer portion 1312 that extends around the outer periphery of the conductors 1320, 1330 and a separator strip 1314 that extends between and engages the opposing flat side surfaces 1322, 1332 of the conductors 1320, 1330. The pair 1300 may be formed by bonding the two partially insulated conductor subassemblies together using the discrete separator strip 1314 and thereafter extruding the outer portion 1312 over the conductors 1320, 1330 and the separator strip 1314. The pair may thereafter be twisted as discussed above with regard to the pair 100. The separator strip 1314 may be bonded to the flat side surfaces 1322, 1332 by adhesive, fusing, heat bonding, or any other suitable method. The separator strip 1314 may be provided as a self-adhesive or non-adhesive tape. The separator strip 1314 and the outer portion 1312 may be formed of the same or different dielectric materials.

Figure 23:
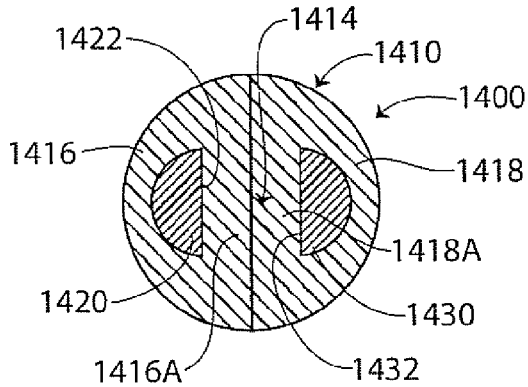
FIG. 23 is a cross-sectional view of a pair according to further embodiments of the present invention.

With reference to FIG. 23, a pair 1400 according to further embodiments of the present invention is shown therein. The pair 1400 is constructed in the same manner as the pair 100 except that the insulation cover 1410 includes two discrete parts that are bonded to one another to form the unitary insulation cover 1410. More particularly, the insulation cover 1410 includes a first cover 1416 that surrounds the first conductor 1420 and a second cover 1418 that surrounds the second conductor 1430. Interior portions 1416A, 1418A of the covers 1416, 1418 are bonded together between the opposing flat side surfaces 1422, 1432 of the conductors 1420, 1430 to form a separator section 1414. The pair 1400 may be formed by extruding the first and second covers 1416, 1418 onto the first and second conductors 1420, 1430 individually, and thereafter bonding the first and second covers 1420, 1430 together using any suitable technique (e.g., adhesive, fusing or heat bonding). The pair may thereafter be twisted as discussed above with regard to the pair 100.

Alternatively, the interior portions 1416A, 1418A of the covers 1416, 1418 may not be bonded together between the flat side surfaces 1422, 1432. Rather, the conductors 620, 630 can be individually insulated with the covers 1416, 1418 as described above and then twisted together such that the flat side surfaces 1422, 1432 face one another as shown but the interior portions 1416A, 1418A are not bonded together. This configuration may likewise reduce the fringing effect.

Figure 24:
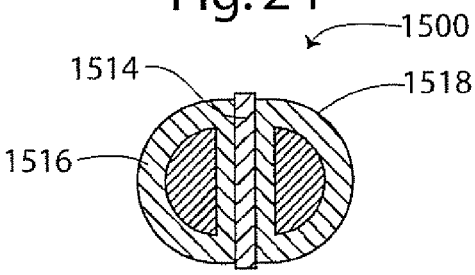
FIG. 24 is a cross-sectional view of a pair according to further embodiments of the present invention.

With reference to FIG. 24, a pair 1500 according to further embodiments of the present invention is shown therein. The pair 1500 is constructed in the same manner as the cable 1400 except that a separator strip 1514 is interposed between the first and second insulation covers 1516, 1518, which are bonded to opposed sides of the separator strip 1514.

Figure 25:
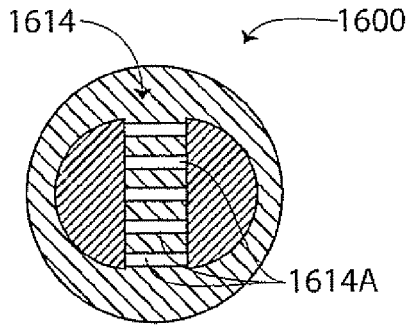
FIG. 25 is a cross-sectional view of a pair according to further embodiments of the present invention.

With reference to FIG. 25, a pair 1600 according to further embodiments of the present invention is shown therein. The pair 1600 is constructed in the same manner as the pair 1300 except that the separator strip 1614 of the pair 1600 defines pockets 1614A containing air or other suitable gas.

It will be appreciated that in some cases the opposed surfaces of the first and second conductors may not be perfectly flat across their width, either as a result of manufacturing variation or permitted or intended deviation. According to some embodiments, the maximum spacing distance between the opposed conductor surfaces is no more than 15% greater than the minimum spacing distance between the opposed conductor surfaces. For example, in the case of the pair 100, the variation in the separation distance D1 would be no more than 15% across the width W1 of each flat surface 122, 132. Similarly, in the case of the pair 700, the variation in the separation distance D3 would be no more than 15% across the widthwise (and curved) extent of the opposing surfaces 722, 732. In the case of the pair 600, the maximum separation distance D4 would be no more than 15% greater than the minimum separation distance D5.

Cables in accordance with embodiments of the present invention may provide a number of advantages. As mentioned above, such pairs may reduce crosstalk between the pairs and twisted conductor pairs of the same or other cable assemblies (e.g., NEXT, FEXT, ELFEXT, ANEXT, and/or AELFEXT). Structural return loss (SRL) and insertion loss (IL) may be reduced as compared to conventionally designed cables. Pairs of the present invention may allow for increased twist capacity, improved fire performance, and/or more efficient insulation material usage.

Other configurations or shapes of conductors may be employed. While conductors having relatively sharp edges adjoining the flat side surfaces have been shown and described, the corners may be rounded corners in accordance with other embodiments.

Other configurations of insulation covers may be employed. According to some embodiments, the insulation cover is circular in cross-section. According to some embodiments, the insulation cover is non-circular, elliptical in cross-section.

According to some embodiments, cables according to embodiments of the present invention and as disclosed herein comply with at least one of the following standards issued by the International Organization for Standardization (ISO), the International Electrotechnical Commission (IEC), the Telecommunications Industry Association (TIA), and/or the Electronics Industries Alliance (EIA): Category 5 (TIA/EIA-568-A); Category 3 (TIA/EIA-568-B.2); Category 5e (TIA/EIA-568-B.2); Category 6 (TIA/EIA-568-B.2-1); Category 6a (TIA/EIA-568-B.2-10); ISO/IEC 11801:2002(E); and IEC 61156-5.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

What is claimed is:

1. A data transmission pair comprising:

first and second longitudinally extending electrical conductors each having a longitudinally extending, substantially flat side surface, wherein the first and second conductors are paired such that their respective flat side surfaces face one another; and an insulation cover having a separator portion and surrounding the first and second conductors, the separator portion being interposed between and separating the respective flat side surfaces of the first and second conductors;

wherein the first and second conductors are helically twisted about one another;

wherein the insulation cover includes the separator portion and an outer insulation portion surrounding each of the first and second conductors, and the separator portion is unitarily extruded with the outer insulation portion; and wherein the spacing distance between the first and second conductors is at least about 0.01 inches.

2. The pair of claim 1 wherein the opposed flat side surfaces of the first and second conductors are oriented substantially parallel to one another.

3. The pair of claim 1 wherein each of the first and second conductors has a cross-sectional shape that is asymmetric.

4. The pair of claim 3 wherein the first and second conductors are each substantially D-shaped in cross-section.

5. The pair of claim 1 wherein the first and second conductors are helically twisted about one another such that the flat side surfaces take the form of helically wound flat surfaces that are substantially parallel to one another along the length of the cable and the separator portion of the insulation cover forms a helically wound ribbon interposed between the flat side surfaces of the first and second conductors.

6. The pair of claim 1 wherein each of the flat side surfaces does not deviate from fully flat by more than 10 mils.

7. The pair of claim 1 wherein a maximum separation distance between the flat side surfaces of the first and second conductors is not more than 15% greater than a minimum separation distance between the flat side surfaces of the first and second conductors.

8. The pair of claim 1 wherein the insulation cover includes pockets defined in the separator portion between the flat side surfaces of the first and second conductors, and the pockets contain gas.

9. The pair of claim 1 wherein the first conductor is between the separator portion and the outer insulation portion of the insulation cover, and wherein a thickness of the outer insulation portion is less than a thickness of the separator portion.

10. A data transmission cable comprising:

first and second longitudinally extending electrical conductors each having a longitudinally extending, substantially flat side surface, wherein the first and second conductors are paired such that their respective flat side surfaces face one another; and a first insulation cover having a separator portion and surrounding the first and second conductors, the separator portion being interposed between and separating the respective flat side surfaces of the first and second conductors;

wherein the first and second conductors are helically twisted about one another; and wherein the first insulation cover further includes an outer insulation portion surrounding each of the first and second conductors, and the separator portion is unitarily extruded with the outer insulation portion;

third and fourth longitudinally extending electrical conductors each having a longitudinally extending, substantially flat side surface, wherein the third and fourth conductors are paired such that their respective flat side surfaces face one another; and a second insulation cover having a second separator portion and surrounding the third and fourth conductors, the second separator portion being interposed between and separating the respective flat side surfaces of the third and fourth conductors;

fifth and sixth longitudinally extending electrical conductors each having a longitudinally extending, substantially flat side surface, wherein the fifth and sixth conductors are paired such that their respective flat side surfaces face one another;

a third insulation cover having a third separator portion and surrounding the fifth and sixth conductors, the third separator portion being interposed between and separating the respective flat side surfaces of the fifth and sixth conductors;

seventh and eighth longitudinally extending electrical conductors each having a longitudinally extending, substantially flat side surface, wherein the seventh and eighth conductors are paired such that their respective flat side surfaces face one another; and a fourth insulation cover having a fourth separator portion and surrounding the seventh and eighth conductors, the fourth separator portion being interposed between and separating the respective flat side surfaces of the seventh and eighth conductors; and an outer cable jacket surrounding the first, second, third and fourth insulation covers;

wherein the spacing distance between each of the first and second conductors, the third and fourth conductors, the fifth and sixth conductors, and the seventh and eighth conductors, is at least about 0.01 inches.

11. The data transmission cable of claim 10 wherein the first conductor is between the separator portion and the outer insulation portion of the first insulation cover, and wherein a thickness of the outer insulation portion of the first insulation cover is less than a thickness of the separator portion of the first insulation cover.

12. The data transmission cable of claim 10 wherein the cable further includes a divider strip that separates at least some of the first through fourth insulation covers from other of the first through fourth insulation covers, and wherein the first through fourth insulation covers are twisted about one another.

13. A data transmission pair comprising:

first and second longitudinally extending electrical conductors paired together and each having a cross-sectional shape that is asymmetric; and an insulation cover having a separator portion and surrounding the first and second conductors, the separator portion being interposed between and separating the first and second conductors;

wherein the first and second conductors are each substantially D-shaped in cross-section; and wherein the first and second conductors are helically twisted about one another;

wherein the first conductor is between the separator portion and an outer portion of the insulation cover, and wherein a thickness of the outer portion is less than a thickness of the separator portion.

14. The pair of claim 13 wherein the separator portion of the insulation cover forms a helically wound ribbon interposed between the first and second conductors.

15. The pair of claim 13 wherein the thickness of the separator portion between the flat side surfaces of the first and second conductors is in the range of from about 0.01 to 0.03 inch.

* * * * *